US009877532B2

(12) United States Patent
Raiffeisen

(10) Patent No.: US 9,877,532 B2
(45) Date of Patent: Jan. 30, 2018

(54) BODY FAN ASSEMBLY

(71) Applicant: Charles J. Raiffeisen, Houston, TX (US)

(72) Inventor: Charles J. Raiffeisen, Houston, TX (US)

( * ) Notice: Subject to any disclaimer, the term of this patent is extended or adjusted under 35 U.S.C. 154(b) by 264 days.

(21) Appl. No.: 14/858,838

(22) Filed: Sep. 18, 2015

(65) Prior Publication Data

US 2016/0100647 A1 Apr. 14, 2016

Related U.S. Application Data

(60) Provisional application No. 62/122,049, filed on Oct. 10, 2014.

(51) Int. Cl.

| | |
|---|---|
| ***A42B 1/00*** | (2006.01) |
| ***F04D 25/06*** | (2006.01) |
| ***F04D 25/08*** | (2006.01) |

(52) U.S. Cl.

CPC ..... *A42B 1/008* (2013.01); *F04D 25/0673* (2013.01); *F04D 25/084* (2013.01)

(58) Field of Classification Search

CPC ..... A42B 1/008; A42B 3/286

USPC ..... 2/171.3, 209.13, 410, 422; 128/201.23

See application file for complete search history.

(56) References Cited

U.S. PATENT DOCUMENTS

| | | | | |
|---|---|---|---|---|
| 3,813,696 | A * | 6/1974 | Yeager | A42B 3/286 2/171.3 |
| 2001/0037519 | A1* | 11/2001 | Paris | A41D 13/11 2/422 |
| 2015/0059069 | A1* | 3/2015 | Arai | A42B 3/222 2/424 |

* cited by examiner

*Primary Examiner* — Katherine Moran
(74) *Attorney, Agent, or Firm* — Law Office of Jeff Williams; J. Oliver Williams

(57) ABSTRACT

The present application includes an assembly having a head unit and a control unit. The head unit is worn on the head of a worker and is configured to induce a convective cooling effect upon the worker. The control unit is in communication with the head unit to permit the worker to operate and adjust the various functions of the head unit. The head unit includes a motorized fan which pulls air into a central cavity within the head unit and blows it through one or more ports. The ports provide multiple directions for routing the airflow. An optional sleeve may be used in combination with one of the ports to route airflow away from the head of the worker.

20 Claims, 4 Drawing Sheets

BODY FAN ASSEMBLY

BACKGROUND

1. Field of the Invention

The present application relates generally to a body cooling device and, more particularly, to a head worn cooling body fan assembly.

2. Description of Related Art

The construction industry employs millions of workers each year. A vast majority of the workers' time is spent outside working in hot and/or humid conditions. The extreme heat experienced in the southern United States and in other countries around the world is typically of great concern. Over exposure and over exertion of oneself can lead to injuries, decreased judgment, and illness.

Presently in an effort to minimize exposure to the heat, workers take a number of precautions. One precaution is to cover the body with hats and cloths to shade the skin from direct exposure to the sun. The cloth loosely covers the skin to allow for airflow to blow across the skin to provide a cooling effect. Another precaution taken is to vary the work schedule to avoid performing work during the peak daylight hours.

Disadvantages of both these precautions exist. First, there is no guarantee to any amount of breeze to cool one's body during working outside. Without a good breeze, workers still suffer a risk of harm. Additionally, with respect to varied work hours, this is not always possible and can be difficult to maintain for the workers over a long period of time.

A new type of body cooling assembly is required to provide shade to people working outdoors, maintains its portability, and provides direct airflow to the person. It is understood that products exist that incorporate a fan into a hat used to blow air on the wearer. These are seen with sporting events primarily. These fans have many limitations and fail to provide direct airflow to a plurality of locations on the wearer.

Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
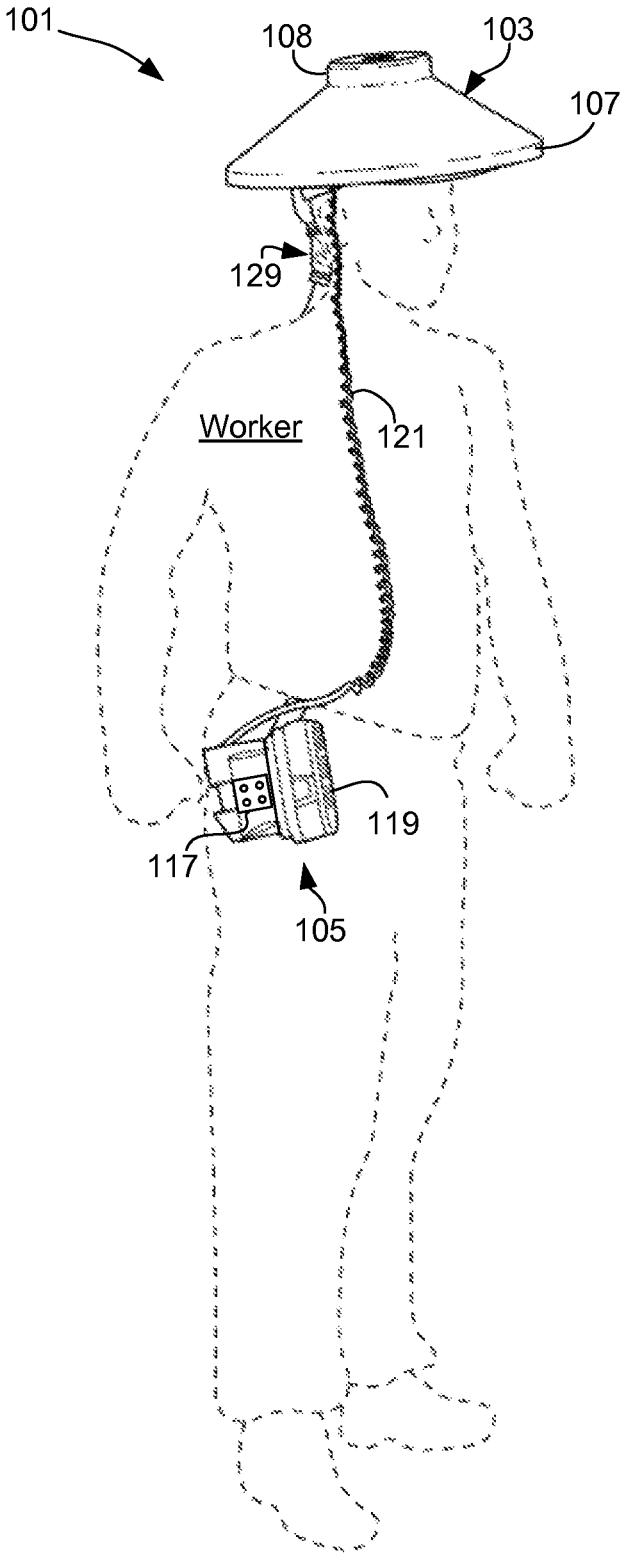
FIG. 1 is a front perspective view of a body fan assembly according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional methods of cooling a body outside. Specifically, the assembly of the present application is configured to generate an external airflow directed at one or more portions of a user's head and body. Air is pulled from around the user and forced across designated portions of the user's body. The assembly is portable with the user and is configured to provide a convective cooling effect across the user's skin. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The body fan assembly of the present application is illustrated in the associated drawings. The assembly includes a control unit and a head unit. The head unit is coupled to the head of a user and includes a fan powered by a motor so as to force air onto the user. The fan and motor is contained within a shell worn by the user. Air is pulled from the ambient air and blown through one or more ports in the shell, toward the user. The user is able to control the operation of the fan via the control unit, also worn by the user.

Figure 2:
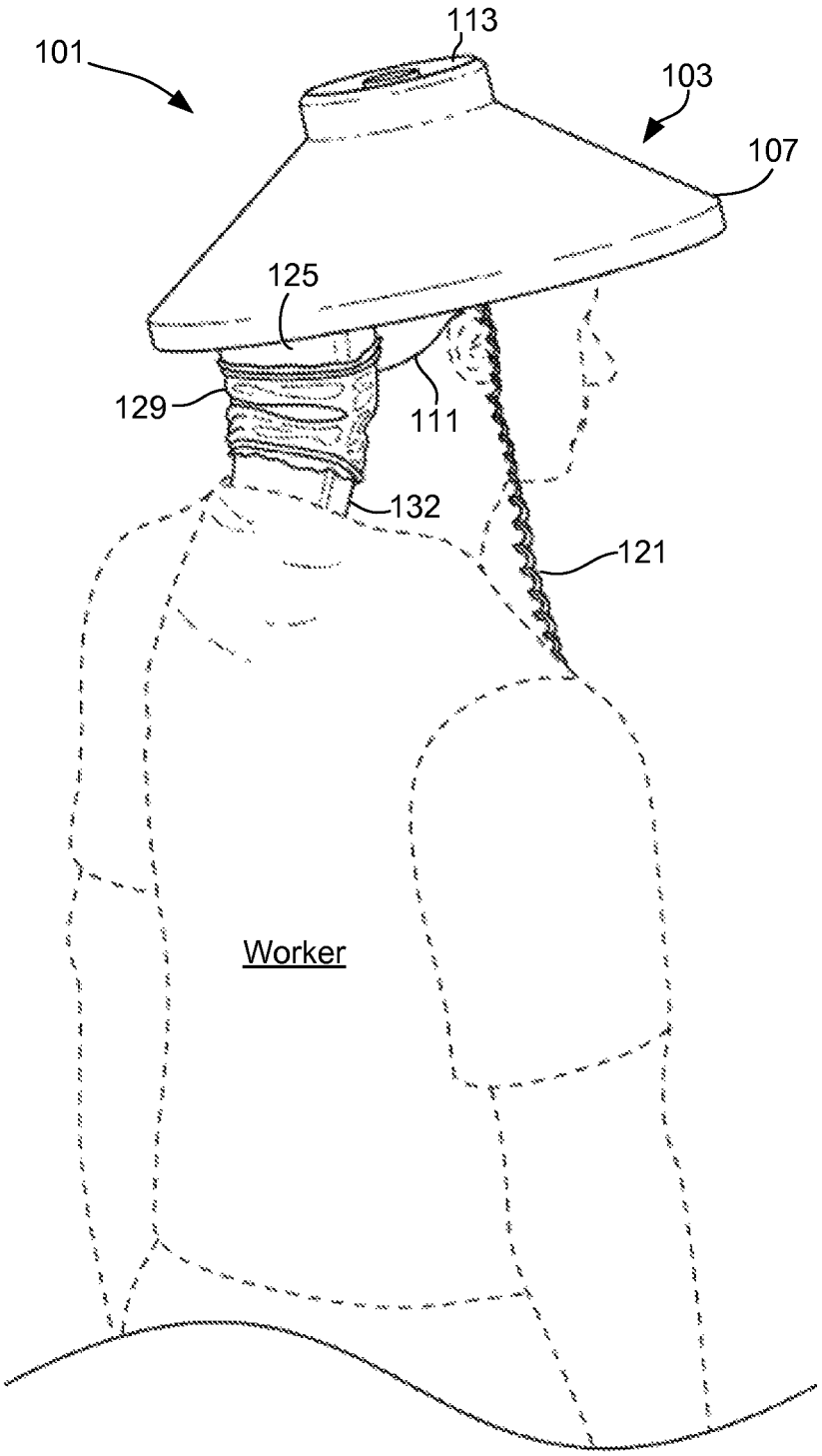
FIG. 2 is a rear perspective view of the body fan assembly of FIG. 1.

Referring now to the drawings wherein like reference characters identify corresponding or similar elements in form and function throughout the several views. FIGS. 1 and 2 illustrate front and rear perspective views of body fan assembly 101. Body fan assembly 101 includes a head unit 103 and a control unit 105. Control unit 105 is configured to regulate the operation of head unit 103, namely that of the motorized fan 109. Head unit 103 includes a shell 107 for housing a motorized fan 109 and a head mounting device 111. Head unit 103 is configured to generate an airflow across a portion of the worker. Assembly 101 is configured to generate the airflow through fan 109 and route it onto portions of a worker wearing assembly 101. Assembly 101 is designed to be worn by a worker on the head. The airflow is produced to provide a convective cooling effect upon the worker to minimize the effects of heat and humidity.

Shell 107 is configured to act similarly to that of a brimmed hat. Shell 107 is to be worn by a worker and is shaped with an elevated center section 108 for housing fan 109, and a sloped outer portion extending down and away from the center section 108 to form the brim. The outer portion extends circumferentially around the worker's head so as to provide shade to the neck and head region of the worker. The shade is useful to provide relief to the worker from the direct rays of the sun. It is understood that the circumferential shape may be varied and does not have to be circular. Other shapes are contemplated and may include oval or asymmetric geometry. Head mounting device 111 is coupled to shell 107 and is configured to locate and secure head unit 103 to the head of the worker. Head mounting device 111 is configured to be adjustable to accommodate various head sizes. Device 111 optionally includes an adjustable ratchet assembly 106 to allow the worker to adjust the size.

It is preferred that shell 107 be made from a rigid material in order to support the weight of fan 109 and device 111. In an effort to minimize weight experienced by the worker, shell 107 is made from light weight materials, such as injection molded plastic, carbon fiber materials, fiberglass, aluminum, and so forth. It is also contemplated that a light weight fabric or canvas may also be used. It is important that shell 107 be constructed to minimize any leakages. The overall shape and function of shell 107 is to provide rigidity and to create an internal volume or cavity 112 (see FIG. 4) for the pressurizing of airflow prior to being routed to the worker.

Control unit 105 is in communication with motorized fan 109 and is configured to regulate the operation of motorized fan 109 through one or more operative controls 117. The worker is able to manipulate controls 117 to turn fan 109 on/off and optionally regulate the speed of rotation. Control unit 105 is carried by the worker in a convenient and accessible location. As seen in the figures, a waist mounted location is ideal for it grants the worker immediate access to controls 117. This may be coupled to the waist of the workers clothing or to various types of belts (i.e. a tool belt). Control unit 105 is configured to also include a power source 119 (i.e. battery).

Power source 119 is configured to provide power to controls 117 and head unit 103. Power and control operation of fan 109 is passed through wires 121. Power source 119 is ideally detachable from control unit 105 to allow for continuous use through the interchanging of multiple power sources. It is contemplated that power source 119 may be similar in form and function to that of power tool portable battery packs commonly found in the market. It is known that power source 119 may be sized and shaped as desired and is not restricted to that depicted. If a smaller power source is used, controls 117 and power source 119 may be more able to attach to the worker in different spots, such as the shirt or on the arm. Additionally, control unit 105 may operate heat unit 103 via wireless controls, which would necessitate a power source to be located in head unit 103.

Figure 3:
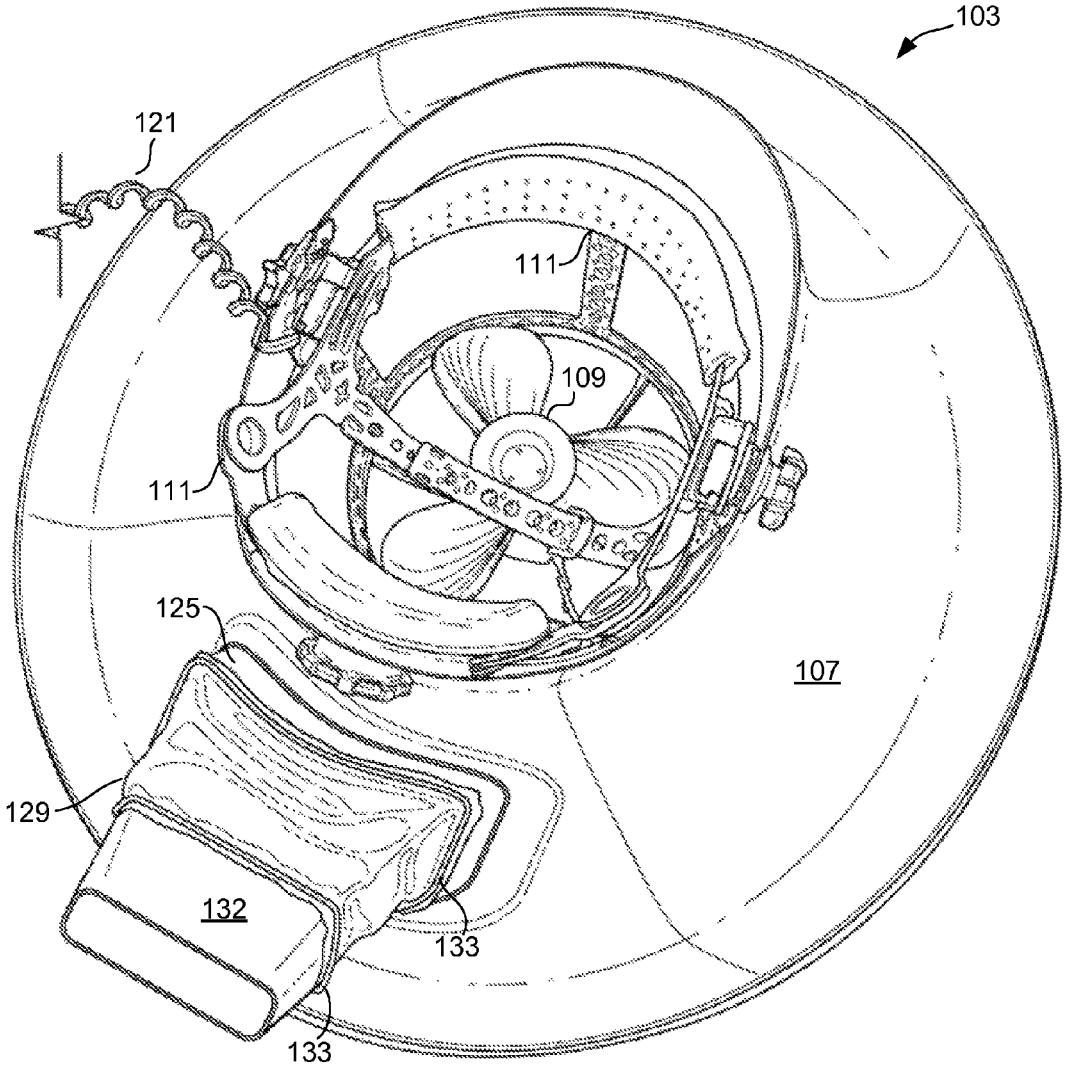
FIG. 3 is a bottom view of a head unit of the body fan assembly of FIG. 1.
Figure 4:
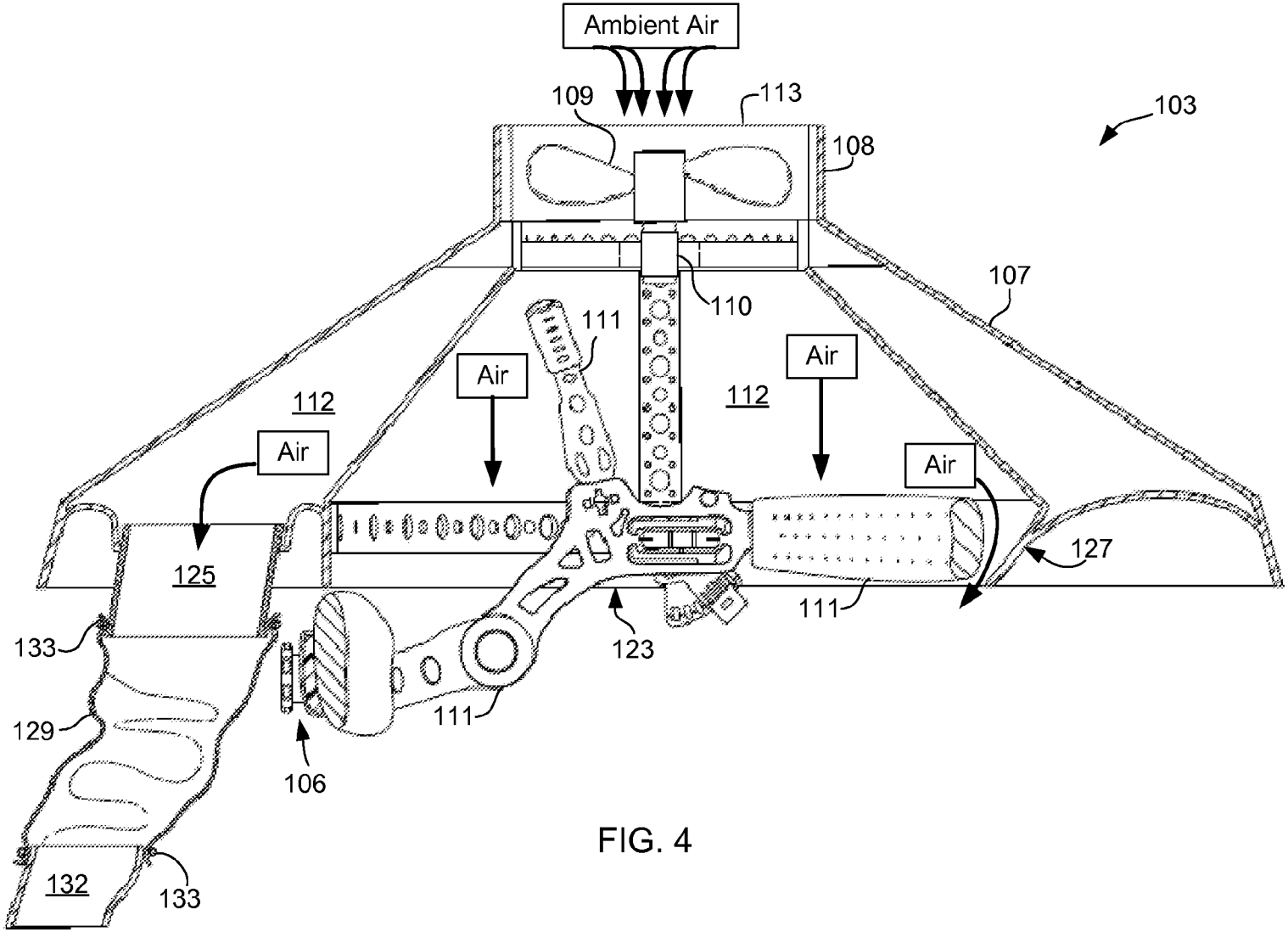
FIG. 4 is a side section view of the head unit of FIG. 3.

Referring to FIGS. 3 and 4 in the drawings, a bottom and section view of head unit 103 is illustrated. Fan 109 is powered by a motor 110 (not shown for clarity purposes in FIG. 3) and is configured to generate the airflow. Fan 109 and motor 110 are mounted within center section 108 of shell 107. Support members used to hold fan 109 and motor 110 may be individually attached to shell 107 as necessary. A common practice, such as resin bonding, may be used to ensure adequate hold. Air is pulled from the ambient air outside and adjacent to shell 107 through an entrance port 113 in the center section 108. The airflow is pulled into shell 107 by motorized fan 109 to pressurize within cavity 112. It is preferred that motor 110 be mounted below fan 109 in order to lower the center of gravity of head unit 103. As the worker bends over and functions, a lower center of gravity will help to ensure that head unit 103 stays stable on the worker's head. Motor 110 is also coupled to shell 107.

As stated above, the airflow is brought into cavity 112 and pressurized before exiting. The airflow is permitted to exit cavity 112 through one or more ports. The ports are located along the lower surface of shell 107, as seen in the Figures, but is not so limited, and may be located on any surface of shell 107. As seen in FIGS. 3 and 4, head unit 103, and in particular, shell 107 can include any one of a scalp port 123, a back port 125, and a facial port 127.

Scalp port 123 is centered above the scalp of the worker. The airflow here is designed to flow directly down onto the scalp of the worker. Facial port 127 is located in a forward portion of the shell and is designed to direct airflow across a portion of the face of the worker. Back port 125 is located in a rear portion of shell 107. Back port 125 is configured to direct airflow across a portion of at least one of the back and neck of the worker. Port 125 in general is used to direct air to any location on the worker not on the head. Ports 123, 125, and 127 are configured to induce the convective cooling effect.

With respect to facial port 127, shell 107 is configured to have an internal sloped surface (45 degrees for example) configured to redirect the air in a rearward direction to permit the face to receive airflow. Facial port 127 is combined in the same opening as scalp port 123 in this embodiment. Other embodiments may allow for scalp port 123 and facial port 127 to be separate apertures in shell 107.

Head unit 103 optionally further includes a sleeve 129 coupled to at least one of the ports for routing of the exiting airflow away from shell 107. Sleeve 129 may be used with any of the ports previously described. For illustration purposes, sleeve 129 will be described in conjunction with back port 125. Sleeve 129 is configured to be flexible (i.e. cloth or light weight fabric for example) in order to allow for the adjustment in direction of the airflow. Sleeve 129 may include some inner wire or mesh material to ensure control of the direction and maintain its form to prevent it becoming pinched, thereby restricting airflow. An external duct 132 may also be used to help maintain shape. Duct 132 may be located at the end of sleeve 129 opposite that of shell 107. Sleeve 129 allows the worker greater control over the locations to receive convective cooling. As seen in FIG. 2, sleeve 129 may be directed under the shirt of the worker in order to cool the back. Sleeve 129 is coupled to port 125 via one or more bands 133.

The current application has many advantages over the prior art including at least the following: (1) a light weight head mounted fan assembly for producing a convective cooling effect on a worker; (2) ability to provide shade; (3) one or more ports to direct and route the airflow; (4) ability to adjust the airflow locations; and (5) power source that is interchangeable with battery powered power tools.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A body fan assembly, comprising:

a head unit configured to generate an airflow across a portion of a user, the head unit including:

a shell worn by the user;

a motorized fan coupled to the shell and configured to generate the airflow, the airflow being pulled into the shell by the motorized fan; and a head mounting device coupled to the shell and configured to locate the shell on the user's head;

one or more ports in the shell for the passage of the airflow outside of the shell; and a detachable and flexible sleeve coupled to and configured to surround an exterior surface of at least one of the one or more ports, the sleeve extending below the shell and includes an inner material to assist in maintaining a particular shape and form to avoid being pinched when flexed; and a control unit in communication with the motorized fan, the control unit configured to regulate the operation of the motorized fan;

wherein the airflow is routed through the shell and directed to one or more portions of the user to induce a convective cooling effect.

2. The assembly of claim 1, wherein the shell is made from a carbon fiber plastic.

3. The assembly of claim 1, wherein the shell is injection molded.

4. The assembly of claim 1, wherein the shell is shaped to circumferentially surround the user's head.

5. The assembly of claim 4, wherein the shell is configured to provide shade to the neck and head region of the user.

6. The assembly of claim 1, wherein the motor is located below the fan in order to lower the center of gravity of the head unit.

7. The assembly of claim 1, wherein one of the ports is a a scalp port adapted to be centered above a scalp of the user, the airflow being directed through the scalp port and across the scalp in order to induce the convective cooling effect.

8. The assembly of claim 1, wherein one of the ports is a a facial port located in a forward portion of the shell, the facial port configured to direct airflow across a portion of the face of the user in order to induce the convective cooling effect.

9. The assembly of claim 1, wherein one of the ports is a back port located in a rear portion of the shell, the back port configured to direct airflow across a portion of at least one of the back and neck of the user in order to induce the convective cooling effect.

10. The assembly of claim 1, wherein the one or more ports are configured to direct airflow across a portion of at least two of the scalp, face, and back or neck of the user.

11. The assembly of claim 1, wherein the head unit is configured to adjust to various head sizes of a worker to ensure a comfortable and snug fit.

12. The assembly of claim 1, wherein the sleeve is configured to be flexible in order to allow for the adjustment in direction of the airflow.

13. The assembly of claim 1, wherein the sleeve is configured to extend beneath the shell sufficiently so as to rest between a user and a shirt of the user to direct the airflow on the back of the user.

14. The assembly of claim 1, wherein the control unit is configured to regulate the speed of rotation of the fan.

15. The assembly of claim 1, further comprising:

a power source configured to provide power to the control unit and the fan.

16. The assembly of claim 15, wherein the power source is detachable from the control unit.

17. The assembly of claim 15, wherein the power source is rechargeable.

18. The assembly of claim 1, further comprising:

an external duct releasably coupled to an end of the sleeve opposite that of the one or more ports, the external duct configured to maintain the shape of the end of the sleeve.

19. A method of generating a convective cooling effect on a user, comprising:

placing a body fan assembly on a head, the body fan assembly configured to generate an airflow across a portion of a user, the body fan assembly including:

a shell worn by the user;

a motorized fan coupled to the shell and configured to generate the airflow, the airflow being pulled into the shell by the motorized fan; and a head mounting device coupled to the shell and configured to locate the shell on the user's head;

one or more ports in the shell for the passage of the airflow outside of the shell; and a detachable and flexible sleeve coupled to and configured to surround an exterior surface of at least one of the one or more ports, the sleeve extending below the shell and includes an inner material to assist in maintaining a particular shape and form to avoid being pinched when flexed; and a control unit in communication with the motorized fan, the control unit configured to regulate the operation of the motorized fan; and adjusting the operation of the motorized fan;

wherein the airflow is routed through the shell and directed to one or more portions of the user to induce a convective cooling effect.

20. The method of claim 19, further comprising:

adjusting the airflow through the one or more ports on the shell.

* * * * *